United States Patent [19]

Johnson, Jr. et al.

[11] 4,262,757

[45] Apr. 21, 1981

[54] CAVITATING LIQUID JET ASSISTED DRILL BIT AND METHOD FOR DEEP-HOLE DRILLING

[75] Inventors: Virgil E. Johnson, Jr., Gaithersburg; T. R. Sundaram, Columbia; Andrew F. Conn, Baltimore, all of Md.

[73] Assignee: Hydronautics, Incorporated, Laurel, Md.

[21] Appl. No.: 931,244

[22] Filed: Aug. 4, 1978

[51] Int. Cl.[3] ..... E21B 7/18

[52] U.S. Cl. ..... 175/67; 175/339; 175/393; 175/422; 239/101

[58] Field of Search ..... 175/56, 65, 67, 69, 175/339, 340, 393, 422; 299/14, 17; 134/1; 239/101, 102

[56] References Cited

U.S. PATENT DOCUMENTS

| | | | |
|---|---|---|---|
| 3,112,800 | 12/1963 | Bobo | 175/67 |
| 3,215,215 | 11/1965 | Kellner | 175/330 |
| 3,315,755 | 4/1967 | Brooks | 175/56 X |
| 3,387,672 | 6/1967 | Cook | 175/69 |
| 3,402,780 | 9/1968 | Goodwin et al. | 175/67 |
| 3,528,704 | 9/1970 | Johnson, Jr. | 299/14 |
| 3,539,104 | 11/1970 | Cooley | 175/67 X |
| 3,545,552 | 12/1970 | Angona | 175/65 |
| 3,603,410 | 9/1971 | Angona | 175/65 |
| 3,713,699 | 1/1973 | Johnson, Jr. | 299/14 |
| 3,838,742 | 10/1974 | Juvkam-Wold | 175/67 X |
| 4,071,097 | 1/1978 | Fulop et al. | 175/340 X |

*Primary Examiner*—James A. Leppink
*Assistant Examiner*—Richard E. Favreau

[57] ABSTRACT

A drill bit and a method for deep-hole drilling in which the drill bit has mechanical cutting means located on its lower cutting face for cutting a solid surface upon rotation of the bit and a plurality of cavitating liquid jet nozzles spaced around the face of the bit to assist in the drilling action, the nozzles being located so as to discharge a plurality of downwardly directed and concentric liquid jets that cavitate to fracture the surface to be drilled in a series of non-overlapping slots as the bit is rotated.

14 Claims, 7 Drawing Figures

CAVITATING LIQUID JET ASSISTED DRILL BIT AND METHOD FOR DEEP-HOLE DRILLING

This invention relates to a new and improved drill bit and to a method for deep-hole drilling. More particularly, this invention relates to a cavitating liquid jet assisted mechanical drill bit to increase the performance of the bit in the drilling of deep-holes.

Rotary mechanical drill bits have long been used in the drilling of deep holes such as oil wells, in which mechanical cutting elements located on the face of the bit fragment the rock or other formation encountered by the bit as it is rotated during the drilling process. The drill bits, which generally are roller cones or diamond drill bits, are mounted at the end of a long series of hollow steel pipes. This series of pipes or drill string commonly serves to transfer torque to the drill that is applied at the top of the string by rotating surface machinery and to deliver circulating mud to the face of the drill bit. Circulating mud is used to wash away the rock fragments formed by the action of the mechanical cutters from the face of the bit and to bring the cuttings up to the surface. Circulating mud is also used to cool the bit and its cutting elements and to prevent excessive overheating.

All of these functions of the drilling mud are important for efficient drilling. For example, if efficient removal of the rock fragments away from the cutting zone is not accomplished, a rapid decrease in drill penetration rates is experienced since the fragments become ground to a fine powdery form and lead to bottom balling or bit balling. Also in diamond bits, if the diamonds are not cooled properly by the circulating fluid, they are easily knocked loose from the bit matrix again leading to decreased penetration rates.

To avoid these problems, drilling bits have been developed in which the circulating mud or fluid is jetted on to the rock face from several suitable arranged nozzles on the face of the bit. The jets can be either straight or angled with respect to the direction of the axis of bit rotation. The pressure of the fluid is generally limited to 2500 psi, which is not of sufficient power to participate significantly in the drilling process, but is generally sufficient to remove the rock fragments away from the cutting zone.

In addition to using fluid in a drilling process to cool and remove rock fragments, it has also been proposed, as shown for example in U.S. Pat. No. 3,881,561 to A. C. Pols et al, to considerably raise the pressure of the fluid and to provide very high pressure, high velocity fluid jets that assist in the drilling function as well as entraining the cuttings and removing them from the cutting zone. The pressure necessary to cause the rock to fracture by the impact of the jets, however, is quite high and generally on the order of 7,000 to 10,000 psi.

It has also been suggested to add abrasive particles to the high pressure fluids to increase their cutting function, as discussed in U.S. Pat. No. 3,112,800 to R. A. Bobo, as well as U.S. Pat. No. 3,838,742 to H. C. Juvkam-Wold. In Juvkam-Wold there is disclosed a tungsten carbide tipped drill bit having a plurality of nozzles extending through the lower end of the bit and positioned to discharge high velocity streams of abrasive laden drilling liquid that cut into the bottom of the bore hole and assist in the drilling action of the bit.

These liquid jet assisted drill bits, however, whether they are abrasive laden or just high velocity fluid jets create damage by impact erosion and as discussed above, demand very high operating pressures and velocities if they are to be used effectively. This significantly increases the cost of the drilling operation. As a consequence, and in view of these high energy requirements, very little use has been made of high velocity fluid jet assisted drill bits that are of a sufficient pressure and velocity to actually take part in the cutting operation. Up to now, the use of fluids has been more particularly limited to the cuttings removal function in view of the significantly lower pressures required.

In U.S. Pat. No. 3,528,704 to V. E. Johnson, Jr, and assigned to the same assignee as the present invention, there is shown apparatus and a method of drilling with a cavitating liquid jet nozzle in which a liquid jet stream, such as water, having vapor cavities formed therein is projected against a solid surface in such a manner that the vapor cavities collapse in the vicinity of the point of impact of the jet with the solid surface. Because the vapor cavities collapse with violence, substantial damage and advantageous erosion can be done to the solid by the jet.

As is well known to those skilled in the art, a cavitating liquid jet nozzle causes substantially more erosion than a non-cavitating liquid jet nozzle at comparable driving pressures and other conditions. Cavitating liquid jet nozzles can accomplish this feat by virtue of the fact that they are specifically so designed as to maximize production of vapor cavities in the jet streams issuing from their exits. These cavities grow as they absorb energy from the flowing stream, and, as they approach a solid surface, they collapse thereby producing very high local pressures. In essence, the nozzles enable the focusing of the available pressure energy in various discrete localized areas, the actual locations of these areas being statistically variable in both space and time.

In U.S. Pat. No. 3,713,699, also to V. E. Johnson, Jr. and assigned to the same assignee as the present invention, there is described an improved method for eroding a solid with a cavitating liquid jet in which the jet stream, such as a cavitating water jet stream, is surrounded with a relatively stationary liquid medium, generally spent water from the jet. The presence of the surrounding water substantially reduces the loss of vapor cavities due to venting, which occurs when the jet is formed in air, and promotes the formation of vapor cavities in the stream by the high velocity stream shearing the surrounding water and creating vortices in the shear zone. Both of these factors increase the number of vapor cavities in the jet and hence its destructive force.

In accordance with the present invention, it has been found that the destructive powers of cavitating liquid jets, and particularly cavitating liquid jets operating submerged, can be used in combination with mechanical drill bits to significantly increase the cutting operation of the mechanical drill bit above that heretofore known and capable of being created by liquid assisted drill bits that operate on impact erosion while substantially reducing operating pressures and costs. In fact, cavitating liquid jet nozzles, when properly positioned with respect to the surface to be eroded, can accomplish significant amounts of rock damage using conventional drilling muds as the liquid and at the relatively low pressures of around 3000 psi normally used to circulate drilling muds and already available in conventional drilling rigs.

More particularly, the present invention provides a drill bit adapted to be rotated about a central axis comprising a drill bit body having a forward face, mechanical cutting means located on the face of the body for cutting a solid surface as the bit is rotated, and a plurality of cavitating liquid jet nozzles located on the face of the bit for discharging a plurality of downwardly directed, liquid jets that cavitate to cause cavitational erosion of the solid surface. Preferably, the mechanical cutting means on the face of the drill bit that are used in combination with the cavitating liquid jet nozzles are diamonds or roller cones, both of which are well known for use in deep-hole drilling.

Further, the present invention provides a method for deep-hole drilling through earth formations which comprises rotating and advancing a drill bit having mechanical cutters on its face downwardly into the hole at a controlled rate of movement, simultaneously discharging from the cutting face of the bit a plurality of downwardly directed cavitating liquid jets containing vapor cavities, surrounding the jets with a liquid medium and impinging the jets against the bottom of the hole at the point where the maximum number of vapor cavities collapse on the hole bottom to thereby cause cavitational erosion as well as mechanical cutting of the formation.

It is to be understood that both the foregoing general description and the following detailed description are exemplary and explanatory but are not restrictive of the invention.

The accompanying drawings which are incorporated in and constitute a part of this specification illustrate several embodiments of the invention and together with the description serve to explain the principles of the invention.

Reference will now be made in detail to preferred embodiments of the invention, examples of which have been illustrated in the above drawings.

Cavitation as used in the specification and claims refers to the formation and growth of vapor-filled cavities in a high velocity flowing stream of liquid issuing from a suitable nozzle where the local pressure surrounding the gas nuclei in the liquid is reduced below the pressure necessary for the nuclei to become unstable, grow and rapidly form relatively large vapor-filled cavities. This critical pressure is equal to or less than the vapor pressure of the liquid. These vapor-filled cavities are convected along with the stream. When the local pressure surrounding the cavities rises sufficiently above the vapor pressure of the liquid, the cavities collapse and enormous pressure and potential destruction is created in the vicinity of this collapse. The effect on solids exposed to such collapsing cavities is called cavitation erosion.

The theory and effect of cavitating liquid jets and various nozzle arrangements for forming cavitating liquid jets can be found in the above mentioned U.S. Patents to V. E. Johnson, Jr. The nozzles described in these patents promote cavitation erosion by virtue of the fact that they are specifically so designed and operated as to maximize local pressure reductions and thereby maximize production of vapor-filled cavities in the jet streams issuing from the orifices of the nozzles.

If the ambient fluid pressure surrounding the jet issuing from a nozzle is denoted as $P_a$ and the pressure in the supply to the nozzle as $P_o$, the jet stream exiting from any nozzle will cavitate at low enough values of the ratio $P_a(P_o-P_a)$, which is defined herein as the cavitation number. However, the various types of cavitating nozzles described in the Johnson patents cavitate at much higher values of the cavitation number than conventional liquid impact erosion type nozzles. The use of the expression cavitating liquid jet nozzle, therefore, in the specification and claims is intended to refer to nozzles of this type that cavitate at substantially higher cavitation numbers.

Figure 1:
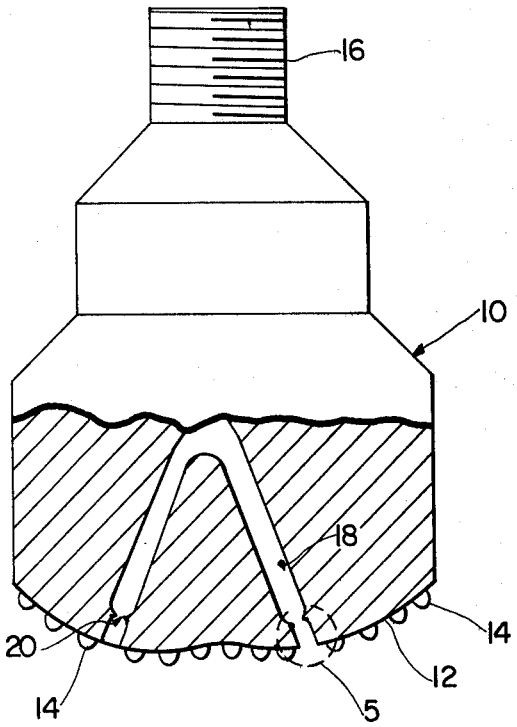
FIG. 1 is a schematic view partially in cross-section of a diamond drill bit constructed according to the present invention having located therein a plurality of cavitating liquid jet nozzles to assist in the drilling function.
Figure 2:
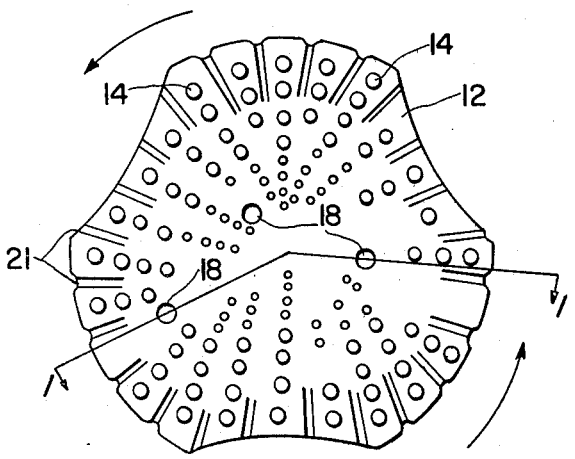
FIG. 2 is a view of the face of the diamond drill bit of FIG. 1.

To illustrate the improvements and advantages realized by the present invention, there is shown schematically in FIGS. 1 and 2 a typical drill bit having a body 10 and mechanical cutting means located on the face 12 of body 10 for cutting a solid surface as the drill is rotated. As embodied, this means may consist of a plurality of diamond chips 14, either natural or synthetic, mounted in a suitable matrix on face 12 of body 10. The construction of such a drill bit is well known to those skilled in the art. The bit is typically provided with threads 16 for connection to the lower end of a drill string (not shown) so that it can be rotated and advanced downwardly by suitable surface machinery.

In accordance with the present invention, there is provided a plurality of cavitating liquid jet nozzles 18 mounted in body 10 of the diamond drill bit that extend through the lower face 12 of the bit to assist in the drilling function. As more fully described below in connection with FIGS. 5 and 6, cavitating liquid jet nozzles 18 induce formation of vapor-filled cavities in downwardly directed high velocity liquid jets issuing from the orifices 20 of the nozzles so that when the nozzles are located at the proper distance from the surface to be eroded, the cavities can be made to collapse on the surface and thereby erode it. Channels 21 are provided on the face 12 to permit circulation of the spent liquid away from the face of the bit. This spent liquid can then be used to cool the face of the bit and wash the rock fragments away from the cutting zone.

Figure 5:
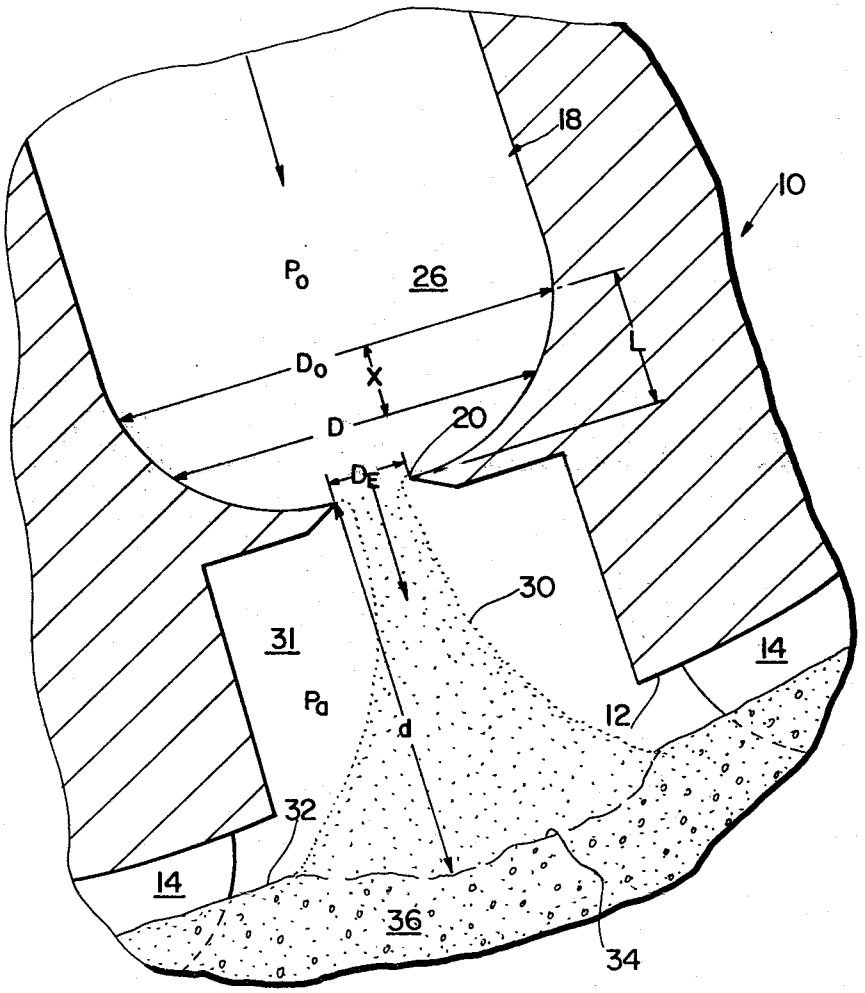
FIG. 5 is an enlarged view of the circled portion in FIG. 1 showing in more detail an embodiment of a cavitating liquid jet nozzle and its relation to the surface being eroded.

The formation of these vapor-filled cavities in high velocity liquid jets is promoted by designing the nozzles to create vortices in their exit flow which have high pressure reductions at their centers. FIG. 5, for example, shows such a nozzle that could readily be used as nozzles 18 in bit 10 having a configuration that is designed to promote the early formation of vapor cavities in the jet stream issuing from the nozzle, particularly when the nozzle is operating submerged so that the jet is exhausted through a similar, but relatively stationary fluid all as more fully described in the aforementioned Johnson U.S. Pat. No. 3,713,699.

Nozzle 18 shown in FIG. 5 consists of an internal chamber 26 which receives liquid under pressure by a suitable connection (not shown) to a source of liquid through drill bit 10. The interior surface of chamber 26 tapers as shown to an outlet opening or restricted orifice 20 at the lower end of the chamber. This tapering of the interior surface of the housing restricts the flow of the liquid and creates a high velocity jet 30.

Suitable liquids for use in the present invention may be water or preferably drilling mud.

In operation of the drill bit, the bit would necessarily be surrounded by spent liquid 31 from the nozzles 18 so that as the jets 30 pass through this relatively stationary fluid, vortices are created in the shear zone between the jets and the surrounding fluid. Low pressures are created in the center of these vortices which promote the formation of the vapor cavities in the jets.

Chamber 26 contracts from an initial diameter $D_0$ to an outlet diameter $D_E$ so as to minimize boundary layer thickness at the exit thereby minimizing vortex core size and maximizing local pressure reduction at the vortex centers. Although many nozzle shapes will achieve these objectives, a typical example can be described, with reference to FIG. 5, by the following formula:

$$\frac{D}{D_O} = 1 - \left(1 - \frac{D_E}{D_O}\right)\left(\frac{D_O}{L} \times \frac{X}{D_O}\right)^n$$

wherein $D_O$ and $D_E$ are as defined above; L is the axial length of the curved part of the nozzle; and D is the diameter at any point at a distance X from the initial diameter $D_O$; and also wherein $D_O/L$ is approximately 2 or greater; $D_O/D_E$ is 3 or greater; and n is 2 or greater.

These nozzles accelerate the exit velocity close to the orifice 20 which minimizes boundary layer thickness and vortex core size and maximizes pressure reduction in the shear zone to thereby maximize the formation of the vapor cavities. The downstream side of orifices 20 should also angle back, preferably around 45°, to maximize pressure reductions at the vortex centers.

If the velocity of the high pressure fluid is accelerated to near the exit velocity long before the fluid reaches the orifice of the nozzle, as is typical in a conical straight sided type nozzle as shown, for example, in the aforementioned patent to Bobo, or the concave nozzle as shown in Pols et al, the boundary layer thickness will build up to a large value before discharge which greatly increases the core size of the vortices in the shear zone and results in the pressure reductions achieved in the vortices and the formation of vapor cavities being greatly diminished.

When the orifice 20 of cavitating liquid jet nozzle 18 is positioned a proper distance d from the surface 32 to be eroded and transversed across it, a slot 34 with a nearly rectangular cross-section is formed and around the slot a zone of fractured rock 36. The width and depth of the slot will necessarily be functions of the diameter of the orifice of the nozzle, its operating pressures and the translation velocity as well as the material properties of the substance being eroded.

Figure 7:
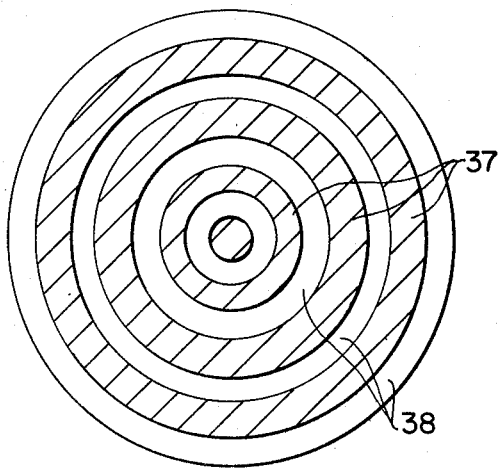
FIG. 7 is a plan view of a preferred pattern of erosion caused by the drill bit of the present invention.

As more specifically shown in FIG. 2, diamond drill bit 10 preferably includes a plurality of cavitating liquid jet nozzles 18 positioned at different radial locations on face 12 of the bit in such a manner that when the drill is rotated and advanced downwardly into the hole, the jets issuing from the nozzles form concentric non-overlapping slots 37 on the rock face on the hole bottom (see FIG. 7). In addition to the slots, and as noted above, the cavitating jets also fracture and weaken narrow zones or regions on either side of and lying adjacent to the slots. In these regions erosive action of the jet is still present, but it is not sufficiently strong to pulverize the rock and form a slot. The radial positions of the nozzles are so chosen in accordance with the present invention that the lands 38 between successive slots are fractured by the erosive action of the jets. The rock material in these lands is then removed by the diamonds 14 embedded on the drill bit face as the bit is rotated. In this fashion, the cavitating liquid jet nozzles 18 are used in drilling both directly through their slotting action and indirectly through their fracturing of the lands between the slots to complement the drilling action of the mechanical cutters.

The exposure of the diamonds 14 in diamond bit 10, which is the distance the diamonds protrude from face 12 of the bit body, maintains a controlled distance between the orifices 20 of nozzles 18 and the rock face. By suitably recessing the nozzles from drill bit face 12 as shown in FIGS. 1 and 5, the rock face 32 will be located at the proper stand-off distance d (see FIG. 5) from the orifice where maximum cavity collapse occurs.

While bits will normally be used in a downward motion, it is to be understood that the invention is equally capable for use on bits moving in any direction and that the jets may be directed at any angle with respect to the direction of motion of the bit.

Figure 3:
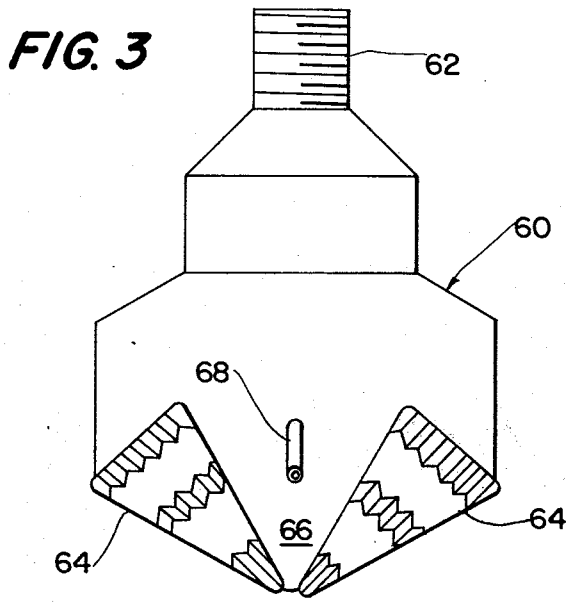
FIG. 3 is a schematic view similar to FIG. 1, but showing a cavitating liquid jet assisted roller cone bit.
Figure 6:
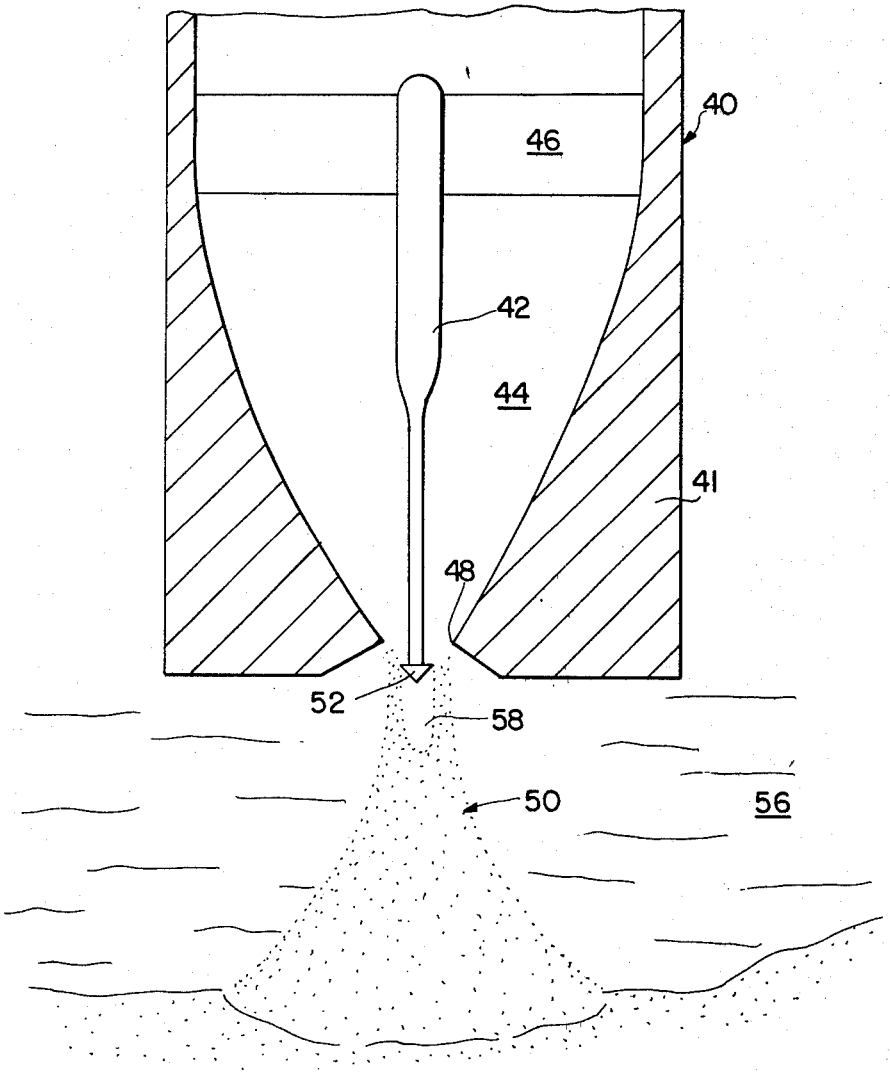
FIG. 6 is a view of an alternative form of a cavitating liquid jet nozzle similar to FIG. 5 and suitable for use in the drill bit of either FIG. 1 or FIG 3.

FIG. 6 shows an alternative embodiment for a cavitating liquid jet nozzle that can also be used to assist the mechanical drill bits of FIG. 1 or 3 in accordance with the present invention. The cavitating liquid jet nozzle 40 as shown in FIG. 6 includes a housing 41 and a center body or stem 42 that is located in the middle of interior chamber 44 and suitably supported in position by radial supports 46 that extend between center body 42 and housing 41. Center body 42 extends down through the orifice 48 and reduces the area of exhaust of the jet 50 issuing from the nozzle.

The center body may be a simple, blunt-based circular cylinder as shown in the aforementioned U.S. Pat. No. 3,528,704, or may be a cylinder terminating in a larger sharp edged disk 52 as shown in FIG. 6. The blunt-based cylinder or disk 52 produces vortices in its wake which, in addition to the vortices created in the shear zone between the jet 50 and the spent liquid 56 surrounding the jet, increases the formation of vapor cavities and hence, the destructive force of the jet. This vortex cavitation in the wake of center bodies occurs at relatively high values of the cavitation number. If the cavitation number is reduced substantially, below the value at which cavitation occurs in the wake vortices, a long trailing vapor-filled cavity 58 forms downstream of the center body and sheds vapor cavities from its tail which move down with jet 50 and collapse on the surface to be eroded.

Figure 4:
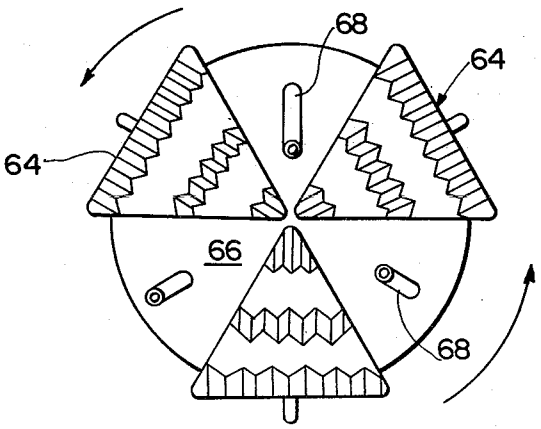
FIG. 4 is a plan view of the face of the roller cone bit of FIG. 3.

The use of cavitating liquid jet nozzles in a roller bit is schematically illustrated in FIGS. 3 and 4 and is similar to that described above, except that the nozzles would be extended rather than recessed so as to operate at the proper stand-off distance. As shown in FIGS. 3 and 4, a roller bit typically consists of a body 60 having threads 62 for connecting the drill bit to a drill string (not shown) and a plurality of conventional rotary drill cones 64 mounted on the face 66 of bit body 60. These cones are supported on shafts (not shown) which in turn are supported by the main body of the drill bit.

In the embodiment shown, three drill cones are placed on axes 120° from each other. Located between each pair of roller cones is a cavitating liquid jet nozzle 68. Nozzles 68 are positioned as in the diamond drill bit of FIGS. 1 and 2 to form concentric non-overlapping slots on the rock face to be drilled so that the lands between successive slots can be fractured by the roller cones as the drill bit is rotated about its axis. As mentioned above, the nozzles extend from the face of the drill bit so as to be able to operate at the proper standoff distance from the rock face, the roller cones being located with respect to the orifices of the nozzle to maintain this proper distance. The nozzles 68 may be of the type shown in FIG. 5 or FIG. 6.

Experiments have been conducted on the drilling rates in various rock samples produced by nozzles of the type described in FIG. 5 and a straight sided conical nozzle under similar conditions. Some typical results are presented in Table 1 below to illustrate that a liquid jet nozzle of FIG. 5 yields considerably superior results.

In these experiments and with reference to the above described formula, the FIG. 5 jet nozzle had the following characteristics: $D_O=1$ in; $D_E=0.25$ in; $L=0.5$ in; and $n=4$. The conical nozzle was a Leach and Walker nozzle having the following characteristics: $D_O=1$ in; $D_E=0.25$ in; $L=3.0$ in; and $n=1$.

The tests were conducted in a pressurized chamber using water as the drilling fluid. To simulate down-hole pressures, the ambient pressure was 3000 psi. The nozzles were located at a standoff distance of 0.50 in.

TABLE 1

| Nozzle Type | Water Flow Rate | Specific Energy* (hp-hr/in.$^3$) Berea Sandstone | Indiana Limestone |
|---|---|---|---|
| Water Jet Nozzle of FIG. 5 | 72 | 0.06 | 0.56 |
| Leach and Walter conical nozzle | 105 | 0.29 | 0.70 |
| Nozzle Driving Pressure | | 4,000 psi | 5,250 psi |
| Operating Cavitation Number | | 3.00 | 1.33 |

*Specific energy indicates the energy required to remove a unit volume of material.

The FIG. 5 nozzle required 79% less energy for the sandstone and 20% less energy for the limestone. The superiority of the FIG. 5 nozzle at such high cavitation numbers is noteworthy. Although the nature of the experiment prohibited a definite determination of the existence of cavitation, it is reasonable to assume that the improved performances were a result of cavitation.

It is to be understood that any form of cavitating liquid jet nozzle including circular as well as noncircular and also those specifically illustrated in aforementioned U.S. Pat. No. 3,528,704, may be used in combination with mechanical drill bits in accordance with the present invention.

Further, pulsing of the liquid jet also adds to the effectiveness of the apparatus and this can be done by valving the supply of liquid to the nozzles as described in aforementioned U.S. Pat. No. 3,528,704.

The present invention thus provides a new and improved drill bit for use in and a method for deep-hole drilling that utilizes the advantageous destructive forces of cavitating liquid jets in combination with conventional mechanical drill bits, such as diamond or roller cone bits. Such a combination achieves a significant advantage not only in terms of an increase in destructive power, but a decrease in energy requirements over high pressure liquid jet assisted drill bits that operate under impact erosion.

The invention in its broader aspects is not limited to the specific details shown and described and departures may be made from such details without departing from the scope of the present invention and without sacrificing its achieved advantages.

What is claimed is:

1. A drill bit adapted to be rotated about a central axis comprising a drill bit body having a lower face, mechanical cutting means located on the face of the bit body for cutting a solid surface as the bit is rotated, and a plurality of cavitating liquid jet nozzles located on the face of the bit for discharging a plurality of downwardly directed, cavitating liquid jets to simultaneously cause cavitational erosion of the solid surface, said cavitating liquid jet nozzles having a housing for receiving liquid, said housing having an interior chamber tapering to a downwardly directed and narrower outlet orifice and shaped in accordance with the following formula:

$$\frac{D}{D_O} = 1 - \left(1 - \frac{D_E}{D_O}\right)\left(\frac{D_O}{L} \times \frac{X}{D_O}\right)^n$$

wherein $D_O$ is the initial diameter of the chamber; $D_E$ is the diameter of the outlet orifice; L is the distance between $D_O$ and $D_E$; and D is the diameter of the chamber at any point between $D_O$ and $D_E$ at a distance X from $D_O$ and wherein $D_O/L$ is approximately 2 or greater; $D_O/D_E$ is 3 or greater; and n is 2 or greater.

2. The drill bit of claim 1, in which the nozzles include a center body located in the outlet of the nozzle to form an annular orifice for the nozzle.

3. The drill bit of claim 2, in which the center body is a blunt based cylinder.

4. The drill bit of claim 1 or 2, in which the mechanical cutting means are diamonds mounted in a suitable matrix on the face of the bit body.

5. The drill bit of claim 1 or 2, in which the mechanical cutting means are roller cones mounted for rotation on the face of the bit body.

6. The drill bit of claim 2, in which the center body is a sharp-edged disk.

7. The drill bit of claim 1 or 2, in which the cavitating liquid jet nozzles are located at different radial locations on the face of the bit body to form a plurality of concentric, nonoverlapping slots on the surface as the bit is rotated.

8. The drill bit of claim 7, in which three cavitating liquid jet nozzles are located at different radial locations on the face of the bit body on axes 120° from each other to form three concentric, non-overlapping slots on the surface as the bit is rotated.

9. A drill bit adapted to be rotated about a central axis comprising a drill bit body having a lower face, mechanical cutting means located on the face of the bit body for cutting a solid surface as the bit is rotated, and a plurality of cavitating liquid jet nozzles located on the face of the bit for discharging a plurality of downwardly directed, cavitating liquid jets to simultaneously cause cavitational erosion of the solid surface, said nozzles having a sharp-edged disk located in the outlet of the nozzle to form an annular orifice for the nozzle.

10. A method for deep-hole drilling through earth formations which comprises rotating and advancing a drill bit having mechanical cutters on its face downwardly into the hole at a controlled rate of movement, simultaneously discharging from the cutting face of the bit a plurality of downwardly directed cavitating liquid jets containing vapor-filled cavities formed by directing a high velocity flow of liquid through nozzles located on the face of the bit that reduce the local pressure surrounding the gas nuclei in the liquid below the vapor of pressure of the liquid to form vapor-filled cavities in the liquid, said nozzles having a housing for receiving the liquid and an interior chamber tapering to a downwardly directed and narrower outlet orifice and shaped in accordance with the following formula:

$$\frac{D}{D_O} = 1 - \left(1 - \frac{D_E}{D_O}\right)\left(\frac{D_O}{L} \times \frac{X}{D_O}\right)^n$$

wherein $D_O$ is the initial diameter of the chamber; $D_E$ is the diameter of the outlet orifice; L is the distance between $D_O$ and $D_E$; and D is the diameter of the chamber at any point between $D_O$ and $D_E$ at a distance X from $D_O$ and wherein $D_O/L$ is approximately 2 or greater; $D_O/D_E$ is 3 or greater; and n is 2 or greater, surrounding the jets with a liquid medium and impinging the jets against the bottom of the hole at the point where the maximum number of vapor-filled cavities collapse on the hole bottom to thereby cause cavitational erosion as well as mechanical cutting of the formation.

11. The method of claim 10, in which the liquid medium surrounding the cavitating liquid jets is spent liquid from the jets.

12. The method of claim 10, which includes pulsing the jets.

13. The method of claim 10, in which the cavitating liquid jets are discharged from the face of the bit so as to form a plurality of concentric non-overlapping slots in the formation at the bottom of the hole as the bit is rotated.

14. The method of claim 13, wherein the cavitating liquid jets are discharged so that the lands formed between the non-overlapping slots in the formation at the bottom of the hole are readily fractured by the mechanical cutters on the face of the bit as the bit is rotated.

* * * * *